United States Patent [19]

Kadija et al.

[11] 4,417,959

[45] Nov. 29, 1983

[54] ELECTROLYTIC CELL HAVING A COMPOSITE ELECTRODE-MEMBRANE STRUCTURE

[75] Inventors: Igor V. Kadija; Kenneth E. Woodard, Jr.; David D. Justice, all of Cleveland, Tenn.

[73] Assignee: Olin Corporation, New Haven, Conn.

[21] Appl. No.: 201,892

[22] Filed: Oct. 29, 1980

[51] Int. Cl.[3] ..... C25B 1/34; C25B 11/03

[52] U.S. Cl. ..... 204/98; 204/128; 204/252; 204/263; 204/283; 204/290 R

[58] Field of Search ..... 204/98, 128, 283, 263, 204/265, 266, 252, 290 R, 290 F

[56] References Cited

U.S. PATENT DOCUMENTS

| | | | |
|---|---|---|---|
| 3,102,085 | 8/1963 | Edwards et al. | 204/130 |
| 3,674,675 | 7/1972 | Leaman | 204/290 F |
| 4,035,254 | 7/1977 | Gritzner | 204/98 |
| 4,076,603 | 2/1978 | Andersen | 204/98 |
| 4,209,368 | 6/1980 | Coker et al. | 204/98 |
| 4,224,121 | 9/1980 | Dempsey et al. | 204/98 |
| 4,253,922 | 3/1981 | Welch | 204/98 |
| 4,340,452 | 7/1982 | De Nora | 204/129 |

FOREIGN PATENT DOCUMENTS

| | | | |
|---|---|---|---|
| 905141 | 9/1962 | United Kingdom | 204/258 |

OTHER PUBLICATIONS

A. Tentorio and U. Casolo-Ginelli, Characterization of Reticulate, Three-Dimensional Electrodes, 1978, 195-205, (Journal of Applied Electrochemistry).

Y. Volkman, Optimization of the Effectiveness of a Three-Dimensional Electrode with Respect to its Ohmic Variables, 1979, 1145-1149, (Electrochimica Acta.).

*Primary Examiner*—R. L. Andrews

*Attorney, Agent, or Firm*—James B. Haglind; Donald F. Clements

[57] ABSTRACT

A novel electrolytic cell for the electrolysis of aqueous solutions of alkali metal chlorides which comprises a cell housing containing a pair of electrodes of opposite polarity. A hydraulically impermeable ion exchange membrane is positioned between and separates the pair of electrodes. At least one of the electrodes comprises a reticulate electrode where the reticulate electrode is in contact with the membrane. Means are provided for applying an electric potential to the electrodes.

The reticulate electrode in contact with the hydraulically impermeable membrane forms a composite structure which substantially eliminates the gap between the electrode and the membrane.

Employing the novel electrolytic cells for the electrolysis of alkali metal halide solutions results in reduced cell voltages and electrical power consumption. The reticulate electrodes used allow significant reductions in material costs and have increased surface area.

14 Claims, 2 Drawing Figures

ELECTROLYTIC CELL HAVING A COMPOSITE ELECTRODE-MEMBRANE STRUCTURE

This invention relates to electrolytic cells for the electrolysis of alkali metal halides. More particularly, this invention relates to electrolytic cells having reduced cell voltages and increased electrode surface areas.

Production of chlorine and alkali metal hydroxides in diaphragm cells which electrolyze alkali metal chloride solutions has been a commercially important process for a number of years. The diaphragm cell employs an anode and a cathode separated by a fluid permeable diaphragm. Maintenance of the desired fluid permeability of the diaphragm is an economically desirable aspect in the operation of the diaphragm cell. Thus dimensional stability is an important property for materials employed as diaphragms. While asbestos has been the primary material employed in diaphragms in commercial chlorine cells, there has been an extensive search for materials having improved cell life and ionic selectivity. A large number of compositions have been proposed, particularly organic compounds such as vinyl chloride, acrylic acid, tetrafluoroethylene, ethylene, and styrene, among others which have been employed in polymers and copolymers. Recently ion exchange resins have been developed which have favorable ion exchange properties and which are inert to the alkali metal chloride electrolytes.

These ion exchange resins have been formed into hydraulically permeable diaphragms and hydraulically impermeable membranes. Hydraulically permeable diaphragms produced from these resins are dimensionally stable in comparison with asbestos fiber diaphragms. Hydraulically impermeable membranes fabricated from these ion exchange resins are suitable for producing, for example, concentrated solutions of alkali metal hydroxides having very small amounts of alkali metal halides as contaminants.

Electrolytic cells employing these porous diaphragms or impermeable membranes in the electrolysis of alkali metal halides have used foraminous metal electrodes constructed of perforated plates, meshes or screens, and expanded metals. These electrodes employ significant amounts of metal and have a high ratio of metal weight to surface area and have significant polarization values.

As the cost of electric power has increased, various ways have been sought to reduce the cell voltage or the electrode polarization values. One method of reducing the cell voltage is described in U.S. Pat. No. 4,209,368, issued June 24, 1980, to T. G. Coker et al where a foraminous electrode is bonded to a porous diaphragm composed of a cation exchange resin to eliminate the electrode-diaphragm gap. While the cell voltage in the electrolysis of alkali metal halide brines is reduced, the alkali metal hydroxide solutions produced contain high concentrations of the alkali metal halide, and expensive separation processes must be used to produce commercially suitable solutions of the alkali metal hydroxides.

One method of reducing polarization values of foraminous metal electrodes is to employ expensive catalysts to reduce the electrode charge transfer activation barrier. Using these catalysts, any savings resulting from a reduction of power consumption has been offset by the increase in costs for the electrodes. In addition, these catalysts have a relatively short operational life.

A more recent attempt to increase the surface area of electrodes has been the development of the three dimensional electrodes such as reticulate electrodes. A. Tentorio and U. Casolo-Ginelli have described one type of reticulate electrode (J. Applied Electro-Chemistry 8, 195–205, 1978) in which an expanded, reticulated polyurethane foam was metallized by means of the electroless plating of copper. A thin layer of copper (about 0.34$\mu$) was formed which conferred electrical conductivity to the matrix. Galvanic plating was employed to deposit additional amounts of copper. The reticulate electrode was employed in a cell for the electrolysis of a copper sulfate solution. This reticulate electrode, however, requires two separate electroplating operations which increase both the time required and the cost of fabrication. In addition, the geometrical configuration of the foam makes it difficult to obtain uniform coating of the substrate.

Therefore there is a need for an electrolytic cell for the electrolysis of alkali metal halide solutions having reduced cell voltages and electrical power consumption.

It is an object of the present invention to provide an electrolytic cell for the electrolysis of alkali metal halide solutions operating at reduced cell voltages.

Another object of the present invention is to provide an electrolytic cell for the electrolysis of aqueous solutions of alkali metal halides having electrodes operating at reduced polarization values.

A further object of the present invention is to provide a composite electrode-membrane structure.

These and other objects of the invention are accomplished in an electrolytic cell for the electrolysis of aqueous solutions of alkali metal chlorides which comprises a cell housing, a pair of electrodes of opposite polarity positioned in the cell housing, a hydraulically impermeable ion exchange membrane positioned between and separating the pair of electrodes, at least one of the electrodes comprising a reticulate electrode, the reticulate electrode being in contact with the membrane, and means for applying an electric potential to the electrodes.

The novel electrolytic cell of the present invention is illustrated in FIGS. 1 and 2.

Figure 1:
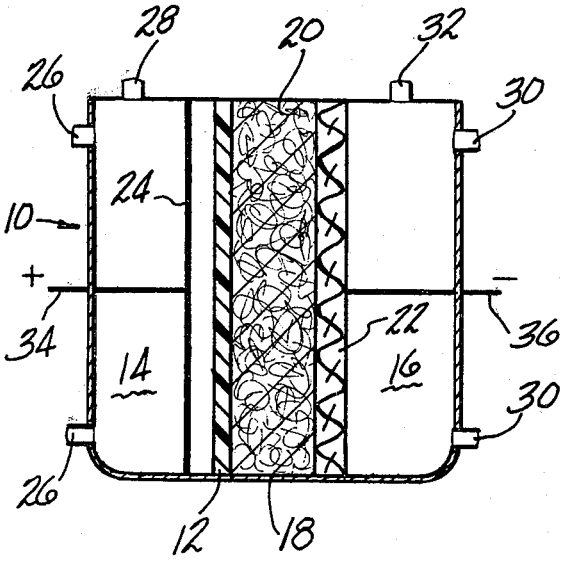
FIG. 1 illustrates a schematic view of one embodiment of the cell of the present invention.

In the schematic view illustrated in FIG. 1, electrolytic cell 10 is divided by hydraulically impermeable membrane 12 into anode compartment 14 and cathode compartment 16. Attached to one side of membrane 12 is reticulate cathode 18 comprised of a plurality of filaments 20 coated with an electroconductive metal and electrically connected to current distributor 22. Anode compartment 14 contains anode 24 spaced apart from hydraulically impermeable membrane 12. Anode compartment 14 contains openings 26 for the introduction and removal of brine to be electrolyzed and gas outlet 28. Cathode compartment 16 has openings 30 for the introduction and removal of liquids and gas outlet 32. Electrical current is fed to anode 24 through conductor 34 and removed from reticulate cathode 18 through conductor 36.

Figure 2:
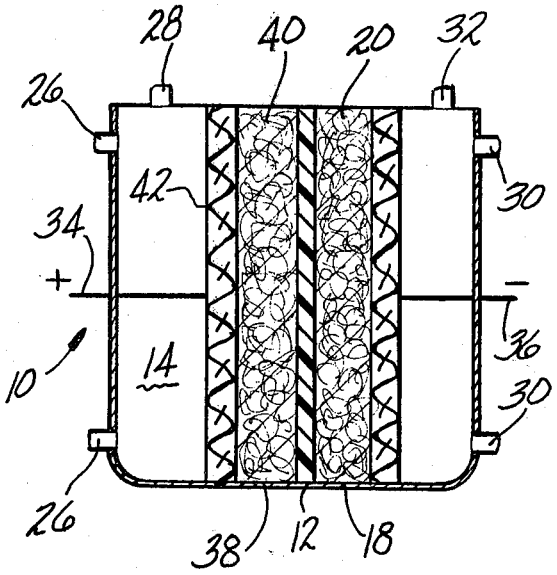
FIG. 2 shows a schematic view of another embodiment of the cell of the present invention.

In the embodiment shown in FIG. 2, hydraulically impermeable membrane 12 is attached on one side to reticulate cathode 18 and on the other side to reticulate anode 38. Reticulate anode 38 is comprised of filaments 40 coated with an electroconductive metal and current distributor 42.

The composite electrode-membrane structure of the present invention is comprised of a hydraulically impermeable membrane and a reticulate electrode. The reticulate electrode has a current distribution means which is incorporated into the electrode or attached to it.

Hydraulically impermeable membranes which can be employed with the electrodes of the present invention are inert, flexible membranes having ion exchange properties and which are impervious to the hydrodynamic flow of the electrolyte and the passage of gas products produced in the cell. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are means to include salts of sulfonic acid or salts of carboxylic acid, for example, alkali metal salts which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. duPont de Nemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic acid compound as described, for example, in U.S. Pat. No. 4,138,373, issued Feb. 6, 1979, to H. Ukihashi et al. A second method of producing the above-described cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable group which can be converted to carboxyl groups. Carboxylic acid type cation exchange membranes are available commercially from the Asahi Glass Company under the trademark "Flemion".

Reticulate electrodes employed in the novel cell of the present invention are comprised of electroconductive filaments and a means of applying an electrical potential to the filaments. The term "filaments" as used in this specification includes fibers, threads, or fibrils. The filaments may be those of the electroconductive metals themselves, for example, nickel, titanium, platinum, or steel; or of materials which can be coated with an electroconductive metal.

Any materials which can be coated with these electroconductive metals may be used. Suitable materials include, for example, metals such as silver, titanium, or copper, plastics such as polyarylene sulfides, polyolefins produced from olefins having 2 to about 6 carbon atoms and their chloro- and fluoro-derivatives, nylon, melamine, acrylonitrile-butadiene-styrene (ABS), and mixtures thereof.

Where the filaments to be coated are nonconductive to electricity, it may be necessary to sensitize the filaments by applying a metal such as silver, nickel, aluminum, palladium, or their alloys by known procedures. The electroconductive metals are then deposited on the sensitized filaments.

In one method of fabricating reticulate electrodes, the filaments are affixed to a support fabric prior to the deposition of the electroconductive metal. Any fabric may be used as the support fabric which can be removed from the reticulate electrode structure either mechanically or chemically. Support fabrics include those which are woven or non-woven and can be made of natural fibers such as cotton or rayon or synthetic fibers including polyesters, nylons, polyolefins such as polyethylene, polypropylene, polybutylene, polytetrafluoroethylene, or fluorinated ethylenepropylene (FEP) and polyarylene compounds such as polyphenylene sulfide. Preferred as support fabrics are those of synthetic fibers such as polyesters or nylon. Fabric weights of 100 grams per square meter or higher are quite suitable for the support fabrics.

Filaments are affixed to the support fabric in arrangements which provide a web or network having the desired porosity. The filaments are preferably randomly distributed while having a plurality of contact points with adjacent filaments. This can be accomplished by affixing individual filaments in the desired arrangement or by providing a substrate which includes the filaments. Suitable substrates are light-weight fabrics having a fabric weight, for example, in the range of from about 4 to about 75 grams per square meter. A preferred embodiment of the substrate is a web fabric of, for example, a polyester or nylon.

Filaments may be affixed to the support fabric or the substrate, for example, by sewing or needling. Where the filaments are affixed to a thermoplastic material, energy sources such as heat or ultrasonic waves may be employed. It may also be possible to affix the filaments by the use of an adhesive.

Where the filaments themselves are not an electroconductive metal, an electroconductive metal is deposited on the filaments, for example, by electroplating.

In an alternate embodiment, the reticulate electrode is formed of metal filaments woven into a web or net which is then attached to a metal support such as a screen or mesh. The metal web may be attached to the support, for example, by sintering or welding. An electroconductive metal may then be deposited onto the filaments.

In another embodiment, the reticulate electrode is fabricated from expanded foam structures such as those of polyurethane or acrylonitrile-butadiene-styrene (ABS) which have been coated with an electroconductive metal.

Any electroconductive metal may be used which is stable to the cell environment in which the electrode will be used and which does not interact with other cell components. Examples of suitable electroconductive metals include nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys. The term "platinum group metal" as used in the specification means an element of the group consisting of platinum, ruthenium, rhodium, palladium, osmium, and iridium.

Where the electrode will contact an ionizable compound such as an alkali metal hydroxide, it is preferred that the electroconductive metal coating be that of nickel or nickel alloys, molybdenum and molybdenum alloys, cobalt and cobalt alloys and platinum group metals and their alloys. Where the electrode will contact an ionizable compound such as an alkali metal chloride, the electroconductive metal coating may be that of a platinum group metal or an alloy of a platinum group metal.

For metal filaments coated with an electroconductive metal, the amount deposited should be sufficient to provide suitable electrochemical activity and the desired electrical properties.

Sufficient amounts of the electroconductive metal are deposited on non-metallic filaments to produce an electrode structure having adequate mechanical strength and which is sufficiently ductile to withstand the stresses and strains exerted upon it during its use in electrolytic processes without cracking or breaking. Suitable amounts of electroconductive metals include those which increase the diameter of the filaments up to about 5 times and preferably from about 2 to about 4 times the original diameter of the filaments. While greater amounts of electroconductive metal may be deposited on the filaments, the coated filaments then tend to become brittle and to powderize.

After deposition of the electroconductive metal has been accomplished, any support fabric present is removed. With cloth-like fabrics, these can be readily peeled off or cut off the metal structure. Non-woven or felt support fabrics can be, for example, loosened or dissolved in solvents including bases such as alkali metal hydroxide solutions or acids such as hydrochloric acid. Any solvent may be used to remove the support fabrics and substrates which will not corrode or detrimentally effect the electrode structure. Heating may also be employed, if desired, to remove the support fabrics. Where a substrate containing the filaments is used, the temperature to which the metal coated electrode is heated should be less than the melting point or decomposition temperature of the substrate.

Reticulate electrodes employed in the cell of the present invention are highly porous, having a porosity in the range of from about 80 percent to about 98 percent, preferably from about 90 to about 98 percent, and more preferably in the range of from about 95 to about 98 percent. The porosity is defined as the ratio of the void to the total volume of the reticulate electrode. These three dimensional electrodes provide high internal surface area, are highly conductive, and are mechanically strong while employing greatly reduced amounts of the electroconductive metal. For example, reticulate nickel electrodes contain from about 2 to about 50, and preferably from about 10 to about 20 percent of the weight of conventional nickel mesh electrodes. For example, nickel reticulate electrodes have an average weight of from about 200 to about 5,000, preferably from about 300 to about 3,000, and more preferably from about 400 to about 1,200 grams of nickel per square meter.

Current is supplied to the reticulate electrode through current distributors which may be separate from or incorporated into the electrodes. Examples of separate current distributors include foraminous metal structures such as screens or meshes which are attached by welding or brazing to the back of the electrode. Current distributors comprised of electrically conductive fabrics and having, for example, hooks or barbs as attachment means can be incorporated into the reticulate electrode on the side opposite that which is in contact with the membrane.

The reticulate electrode is brought in contact with the hydraulically impermeable membrane to form a composite structure. As shown in FIGS. 1 and 2, the reticulate electrode is placed in direct contact along at least one face of the membrane to substantially eliminate the gap between the electrode and the membrane.

In one embodiment, the contact is obtained by heating a face of the membrane to the thermoplastic state and compressing the reticulate electrode against it to form a bonded composite structure.

In another embodiment, the reticulate electrode is pressed against the face of the membrane using mechanical means of compression such as springs or clamps. For example, the reticulate electrode may be compressed against the face of the membrane by a spring which is concentric with the conductor supplying or removing current from the reticulate electrode.

Where the composite structure is formed by attaching the reticulate electrode to the hydraulically impermeable membrane, prior to its use in the electrolysis of aqueous solutions of alkali metal halides, it may be necessary to convert the membrane to its alkali metal ion form. For example, where the composite structure is comprised of a membrane and a cathode, this can be accomplished by treating the composite structure, for example, with an alkali metal hydroxide solution. In the case of the composite structure being comprised of a membrane and an anode, the structure may be treated with, for example, an alkali metal halide solution.

When employed in the electrolysis of aqueous salt solutions such as alkali metal chloride brines, the composite structure provides a significant reduction in cell voltage, for example, in the range of from about 5 to about 17, and preferably from about 10 to about 17 percent. Use of the composite structure produces concentrated solutions of alkali metal hydroxides which are free from contamination with alkali metal chlorides on the hydraulically impermeable membrane prevents bulk flow of the brine solution being electrolyzed.

The reticulate electrodes employed allow significant reductions in material costs over foraminous metal electrodes of the prior art while also greatly increasing the surface area of the electrode.

Electrolytic cells in which the composite structure may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. Where the reticulate electrode has, for example, a coating of a platinum group metal.

The novel electrolytic cell of the present invention is illustrated by the following example without any intention of being limited thereby.

EXAMPLE 1

A web of silver coated nylon fibers (20 grams per square meter; fiber diameter about 10 microns) was needled onto a section of a polyester cloth (250 grams per square meter; air permeability 50 cubic meters per minute per square meter). A current distributor was attached to the web and the web-polyester cloth composite was immersed in an electroplating bath containing 450 grams per liter of nickel sulfamate and 30 grams per liter of boric acid at a pH in the range of 3–5. Initially electric current was passed through the solution at a current density of about 0.2 KA/m2 of electrode surface. After about 10 minutes, the current was increased to provide a current density of 0.5 KA/m2. During the electroplating period of about 3 hours, an electroconductive nickel coating was deposited on the silver fibers. Where adjacent fibers touched, plated joints formed to bond the fibers together into a network. After removal from the plating bath, the nickel plated structure was rinsed in water. The polyester fabric was peeled off and a reticulate nickel plated electrode structure obtained having a porosity of 96 percent and weight of 580–620 grams per square meter in which the nickel coated fibers had a diameter, on the average, about 30 microns. The reticulate nickel electrode was heated at a temperature of 250°–280° C. A hydraulically impermeable membrane in the ester form was placed on top of the electrode and allowed to heat up to the same temperature. A pressure of about 10 psi was applied to form a bond between the membrane and the electrode and a composite structure formed. The composite structure was allowed to cool and then placed in a solution of 25 percent NaOH and heated to 80° C. for about 16 hours to hydrolyze the membrane. The membrane treatment had no effect on the bond between the membrane and the reticulate nickel electrode. The composite structure was installed in an electrolytic cell containing a titanium mesh anode. The cathode compartment contained a solution of 30 percent NaOH and the anode compartment was fed a 25 percent NaCl brine. During operation of the cell at 80° C., at a current density of 2.0 KA/m2, the cell voltage was 3.10 volts; at a current density of 3.0 KA/m2, the cell voltage was 3.56 volts.

What is claimed is:

1. An electrolytic cell for the electrolysis of aqueous solutions of alkali metal chlorides which comprises a pair of reticulate electrodes of opposite polarity separated by a hydraulically impermeable ion exchange membrane, each of said reticulate electrodes being a three dimensional structure and comprised of a plurality of electroconductive filaments randomly distributed while having a plurality of contact points with adjacent filaments, said reticulate electrodes, having a porosity of from about 80 to about 98 percent, being in contact with said membrane, and means for applying an electric potential to said reticulate electrodes, said means comprised of electrically conductive fabrics having hooks or barbs as attachment means to said reticulate electrode.

2. A process for the electrolysis of aqueous solutions of alkali metal halides employing the electrolytic cell of claim 1.

3. The process of claim 2 in which said aqueous solutions of alkali metal halides comprises alkali metal chloride brines.

4. The process of claim 3 in which said alkali metal chloride brines comprise sodium chloride brines having concentrations of from about 200 to about 350 grams per liter of NaCl.

5. A composite structure for use in the electrolysis of aqueous solutions of alkali metal halides which comprises a reticulate electrode in contact with a hydraulically impermeable membrane, said reticulate electrode being a three dimensional structure and comprised of a network of a plurality of electroconductive filaments comprised of plastics selected from the group consisting of polyolefins, nylon, melamine, and acrylonitrile-butadiene-styrene having a coating thereon of an electroconductive metal, said electroconductive filaments being randomly distributed while having a plurality of contact points with adjacent filaments, and having a porosity of from about 80 to about 98 percent.

6. The composite structure of claim 5 in which said reticulate electrode is a cathode.

7. The composite structure of claim 5 in which said reticulate electrode is an anode.

8. The composite structure of claim 5 in which said hydraulically impermeable ion exchange membrane is a cation exchange membrane comprised of a fluorocarbon polymer having pendant sulfonic acid groups or carboxylic acid groups.

9. The composite structure of claim 5 in which said electroconductive metal is selected from the group consisting of nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys.

10. An electrolytic cell for the electrolysis of aqueous solutions of alkali metal halides which comprises a cell housing, a pair of electrodes of opposite polarity positioned within said cell housing, a hydraulically impermeable ion exchange membrane positioned between and separating said pair of electrodes, at least one of said electrodes comprising a reticulate electrode, said reticulate electrode being a three dimensional structure and comprised of a network of a plurality of electroconductive filaments comprised of plastics selected from the group consisting of polyolefins, nylon, melamine, and acrylonitrile-butadiene-styrene having a coating thereon of an electroconductive metal, said electroconductive filaments being randomly distributed while having a plurality of contact points with adjacent filaments, said reticulate electrode, having a porosity of from about 80 to about 98 percent, being in contact with said membrane, and means for applying an electric potential to said electrodes.

11. The electrolytic cell of claim 10 in which said electroconductive metal is selected from the group consisting of nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys.

12. The electrolytic cell of claim 10 in which said hydraulically impermeable ion exchange membrane is a cation exchange membrane comprised of a fluorocarbon polymer having pendant sulfonic acid groups or carboxylic acid groups.

13. The electrolytic cell of claim 12 in which said reticulate electrode is a cathode.

14. The electrolytic cell of claim 12 in which said reticulate electrode is an anode.

* * * * *